United States Patent [19]

Dupuy

[11] Patent Number: 4,826,004

[45] Date of Patent: May 2, 1989

[54] DISPLAY BOXES

[75] Inventor: Francois Dupuy, Les Grands Moulins-Dignac, France

[73] Assignee: Dupuy Engineering S.A., France

[21] Appl. No.: 158,031

[22] Filed: Feb. 12, 1988

Related U.S. Application Data

[63] Continuation of Ser. No. 329,335, Dec. 10, 1981.

[30] Foreign Application Priority Data

Dec. 11, 1980 [FR] France ..... 80 26305
Jul. 2, 1981 [FR] France ..... 81 13025

[51] Int. Cl.[4] ..... B65D 25/00

[52] U.S. Cl. ..... 206/45.34; 206/45.31; 229/16 D

[58] Field of Search ..... 206/45.31, 45.34, 44 R; 229/16 D

[56] References Cited

U.S. PATENT DOCUMENTS 2,233,207 2/1941 Gillan ..... 206/45.34
2,589,002 3/1952 Page, Jr. et al. ..... 206/45.34
3,199,670 10/1965 Palmer ..... 206/45.34
3,273,702 9/1966 Palmer ..... 206/45.31
3,292,513 12/1966 Palmer ..... 83/880
3,870,221 3/1975 Zeitter ..... 206/45.31
4,664,648 5/1987 Dupuy ..... 206/45.31

*Primary Examiner*—David T. Fidei
*Attorney, Agent, or Firm*—Sughrue, Mion, Zinn, Macpeak, and Seas

[57] ABSTRACT

This invention relates to a display box of the kind comprising a part of an opaque material such as cardboard and an opening overlapping or straddling at least one edge of the box and which is shut off by a sheet of a plastics material. According to the invention the sheet is formed from a rigid plastics material.

The sheet may be formed by a single sheet and have two preparatory or incipient folds produced by pre-scoring or pre-grooving along the lines corresponding to the edges which are to be produced, the edges of the plastics sheet having notches at the extremities of each incipient fold.

The invention also provides a method of and apparatus for manufacturing the box.

4 Claims, 7 Drawing Sheets

DISPLAY BOXES

This is a continuation of application Ser. No. 329,335, filed Dec. 10, 1981.

BACKGROUND OF THE INVENTION

The present invention relates to the production of display boxes for a variety of products. A large variety of boxes of this kind is known in which the actual display of the contents of the box is provided by means of a window formed by an aperture in the wall of the box covered by a transparent sheet of plastics material as a rule, which is applied to the interior of the box.

No problem of any kind arose of the window did not extend beyond one surface of the box and was limited in surface in such manner as not to overlap the edge folds.

On the other hand, for example in the case of a rectangular box, if it was wished to produce a window overlapping at least one edge fold, it was necessary in view of the presence of fold projections or the like on the cardboard panel, to make use of a thin and pliable sheet of plastics material. The result was that if the window had a considerable area, the box lacked stiffness and this raised problems for example whilst filling or handling the same.

Boxes of this kind which comprise windows extending across one or more edges of the box are known and, for example, described in the U.S. Pat. Nos. 3,292,513 and 3,273,702. In accordance with these two prior patents however, the windows are covered with sheets of a flexible or semi-rigid transparent plastics material.

In the U.S. Pat. No. 3,273,702, the box comprises a panel 2 of opaque cardboard which in known manner has incipient or preparatory fold lines *6a*, *6b*, *6c*, *6d* and *6e* (FIG. 3) delimiting the different sides 10, 12, 14, 16 and 18 of the box. The cardboard panel 2 has an opening 32 covered by a transparent sheet 4 which comprises fold lines 34 and excisions 36 situated in alignment with the extension parts or projections 38 of the cardboard panel. The sheet 4 of plastics material should be a semi-rigid sheet which is sufficiently flexible to be capable of being folded at a comparatively acute angle without a preparatory fold line or crease. The plastics material utilised in accordance with this patent are polystyrene, or bi-axially oriented PVC (column 3, lines 35 to 50). Furthermore, FIG. 2 clearly shows that the sheet 4 is actually a pliable sheet, allowing for the very founded off folding angles illustrated in particular in the upper part of the sheet 4.

The U.S. Pat. No. 3,292,513 discloses a box of a similar kind, in which the opening cut-out of a cardboard panel is covered with a plastics material sheet 28. In this case however, the form of excision of the opening which is comparatively complex and comprises reinforcing strips for the plastics material sheet, clearly demonstrates that the plastics material sheet should be a flexible sheet.

The boxes in accordance with these prior patents consequently lack stiffness which entails considerable trouble when it is required to store and handle them. Furthermore, they are unusable for packaging heavy elements such as bottles filled with a liquid. Finally, their production is complex and expensive as demonstrated in particular by the U.S. Pat. No. 3,292,513.

SUMMARY OF THE INVENTION

It is a primary object of the invention to make a box of the kind comprising a part of opaque material such as cardboard, and an opening overlapping at least one edge of the box and closed off by a sheet of plastics material, but which is of such nature as to eliminate or minimise the disadvantages hereinbefore described.

In accordance with the invention, the plastics material sheet forming the window is of rigid transparent material.

The rigid sheet consequently does not weaken the box and maintains its mechanical strength. To eliminate the problems raised by the fold projections of the cardboard panel, use is made of a rigid sheet of PVC for example, the rigid sheet being weakened along two lines corresponding to the edges to be formed. This weakening may be performed directly by prescoring.

In accordance with a preferred embodiment, the sheet consists of a single sheet and has two preparatory or incipient fold lines produced by pre-scoring along the lines corresponding to the edges which are to be formed, the edges of the sheet having notches at the extremities of each such preparatory or incipient fold.

In a modification the plastics material sheet comprises a composite sheet formed from a pliable sheet and rigid elements, the rigid elements being clear of the edges of the box.

The invention also consists in a method of and apparatus for manufacturing a box according to the invention.

The method of manufacture in accordance with the invention consists in applying a single or double sheet cut after continuous withdrawal from a reel on to a cardboard panel cut to shape and coated with adhesive.

In a modification, a sheet drawn singly from a magazine in which a plurality of sheets is held in readiness for laying, may be associated with a panel cut to shape and coated with glue or other suitable adhesive, but hereinafter generally referred to as glue.

For carrying out the manufacturing method the invention consists in apparatus which comprises, in this order, a panel supply means, a feeder, a gluing station, means of supplying sheet material from a reel and discharge or delivery means and a station for cutting and laying the plastics material sheet comprising a suction cylinder.

If the plastics material sheets are available in the form of precut individual sheets, the apparatus includes suction or negative pressure supply means, a glue-coating station, a hot-melt station, a sheet magazine, a pressing station and a passing mat or the like at the outlet. In this case, the supply of plastics material sheets is provided by means of suction operating via the opening of the cardboard panel whilst the sheet magazine is positioned at the other side of the panel opposite the suction device.

The method and apparatus of the invention render it possible to secure satisfactory results, but the pre-scored plastics material sheet must be positioned with high precision on the cardboard panel so that its scored lines are properly aligned to or in register with those of the cardboard. The least error in alignment becomes manifest afterwards by trouble in the folding of the box. A high-precision positioning or setting operation cannot be preformed on automatic machines except at lowered production speeds, which entails a substantial increase in cost.

Accordingly the invention also relates to a manufacturing method which renders it possible to eliminate or minimise this disadvantage.

This method consists in cutting the said opening from a cardboard panel larger than the panel forming the box, placing the said plastics material sheet, which is larger than the said opening, on the opening, securing the said sheet along the edges of the said opening on the cardboard panel, scoring the said sheet to form preparatory or incipient fold lines abreast of the edge or edges of the box, scoring the cardboard sections of the box and cutting from the panel the cardboard sections intended to form the box with the said sheet. This avoids the necessity of positioning the plastics material sheet with a high degree of precision, which thus enables high production speeds to be obtained corresponding to those achieved during the production of boxes wholly formed from cardboard.

According to a particularly advantageous embodiment of this method, the scoring of the said sheet of plastics material and of the cardboard sections of the box is performed by mechanical means, and it is advantageous in this case to perform simultaneous scoring of the said sheet of plastics material and of the cardboard sections of the box.

The plastics material sheet may be affixed on the cardboard panel by bonding and preferably by hot-melting or fusion, for example by HF welding.

In this latter case, the scoring action on the said plastics material sheet may be performed in accordance with the invention by means of heating means which heat-weaken the parts of the sheet corresponding to the scored lines which are to be formed. In this manner, it is possible to perform the fastening of the plastics material sheet on to the cardboard panel and the scoring of this sheet in a single stage and with a single tool.

If the plastics material sheet has notches at the ends of its scored lines, the scored lines and the notches of the said plastics material sheet may be made simultaneously and by the same means, according to this method. Several operations performed with an identical tool are thus combined within the same stage of an automatic production process, which represents a great saving of facilities, reducing the production cost of the boxes.

According to another embodiment, the scoring action on the said plastics material sheet and the scoring and excising action on the cardboard sections of the box, may be performed at the same time and by the same means. This allows for an even greater reduction of the number of operations and handling actions needed for production of the box.

According to another and particularly economical version of the manufacturing method, the excision of the said opening, the scoring of the cardboard sections and a partial cutting out of the cardboard sections intended to leave behind bridges between these sections and the remainder of the cardboard panel, said bridges being intended to be broken at the time of completing production after affixing the said plastics material sheet, may be performed at the same time and by the same means. This is highly advantageous if several boxes are produced from one and the same cardboard panel.

BRIEF DESCRIPTION OF THE DRAWINGS

In order that the invention may be more clearly understood, reference will now be made to the accompanying drawings which, by way of example, show several embodiments of the box in accordance with the invention and of the method of and apparatus for manufacturing it, and in which.

DETAILED DESCRIPTION OF PREFERRED EMBODIMENTS

Figure 1:
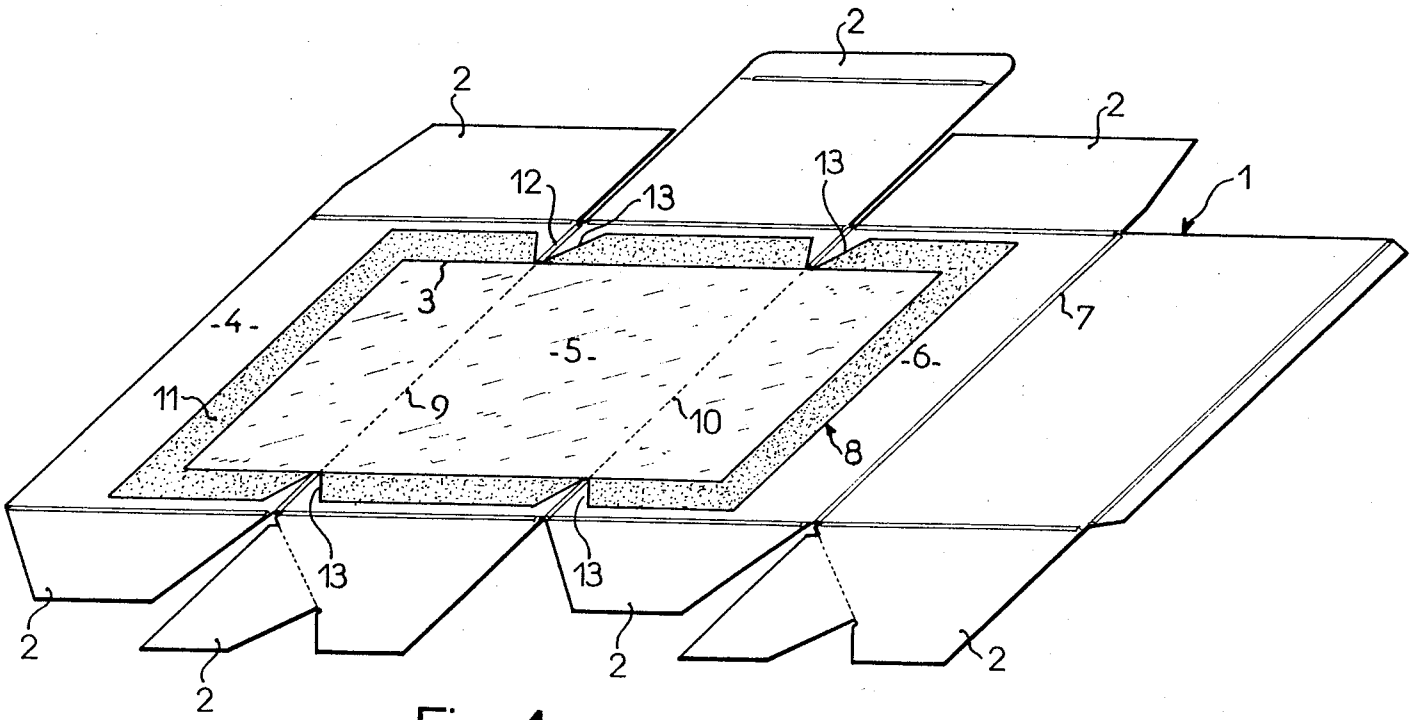
FIG. 1 is a view of a first embodiment of the box in flat form.

Referring now to the drawings, the box shown in flat form in FIG. 1 comprises a cardboard panel 1 having a series of flaps enabling, for example, a rectangular box to be formed. A rectangular display or sight opening 3 which extends over three of the surfaces 4, 5 and 6 of the lateral surface of the box, is formed in the panel 1. To form the shape of the box, the different sections of the cardboard panel 1 are prefolded and projections are formed abreast of the fold lines as illustrated at 7 in FIG. 2*a*.

The opening 3 is closed off by a sheet of transparent plastics material 8. This sheet is preferably produced from PVC (polyvinylchloride). In the case of FIG. 1, it comprises a single rigid sheet. Abreast of the edge folds 9 and 10 it has weakening lines formed by scoring or grooving. The sheet 8 is glued to a peripheral strip 11. The adhesive utilised will preferably be of the hot-melt type.

Difficulties in respect of bending, adhesion and corrugation are encountered at the level of the fold projections 7, since the sheet 8 is rigid.

To eliminate these difficulties, the edge of the sheet 8 has notches or excisions 13 at the level of these projections, for example at 12. The bottom of these notches 13 is situated at the level of the edge of the opening 3 of the panel and does not reach the extremity of the projections 12 in any event.

Upon forming the box shape, the weakening lines 9 and 10 form the edges at the level of the box window.

The folding projections 7, 12 no longer impede this folding action due to the presence of the notches 13.

Figures 2, 2A:
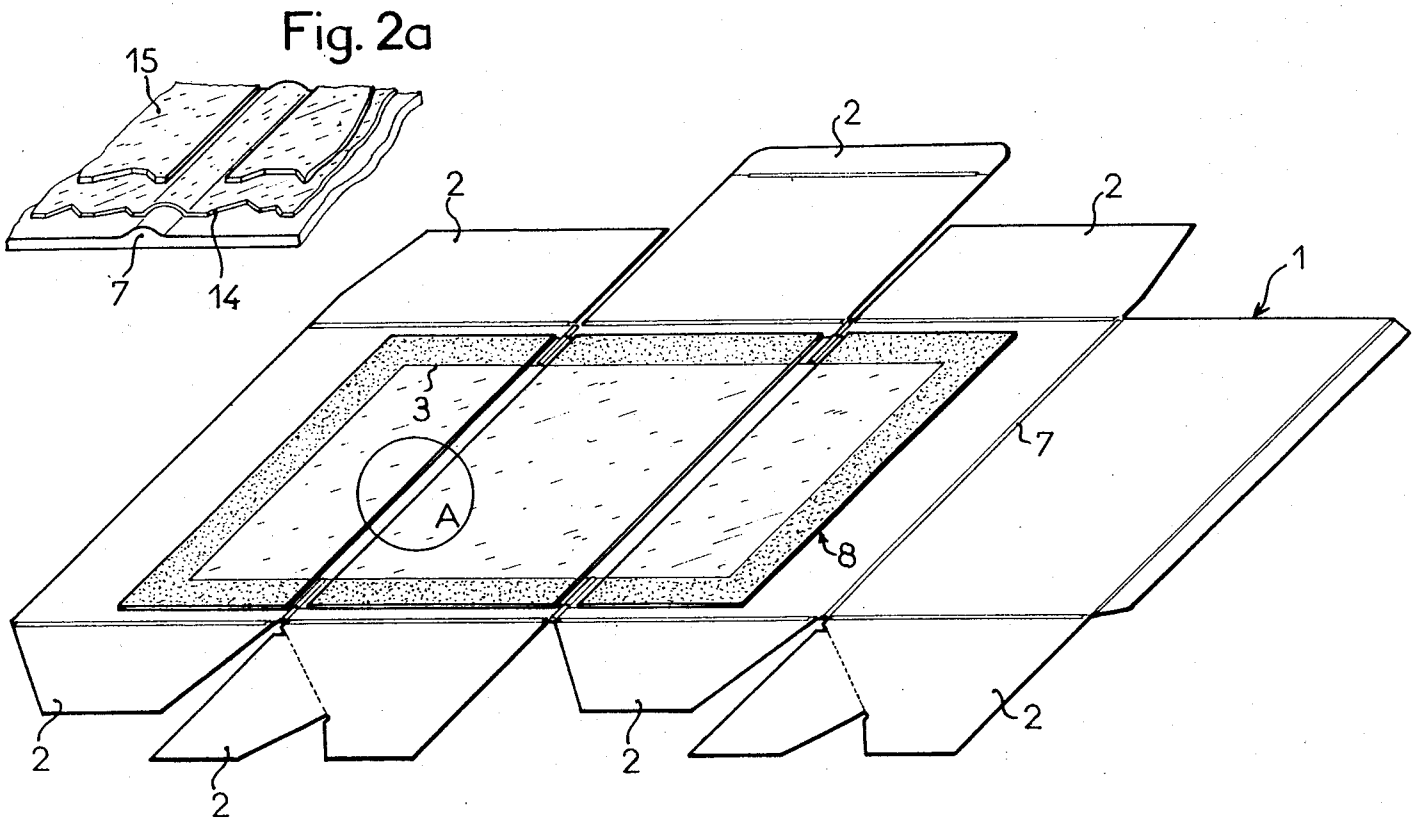
FIG. 2 is a view of a second embodiment of the box in flat form.
FIG. 2*a* is an enlarged-scale view of a detail portion A of FIG. 2.

The box illustrated in FIG. 2 is identical to that of FIG. 1 in respect of the cardboard panel 1, the opening 3 and the fold projections 7. Only the transparent plastics material sheet 8 is different. In this case, it comprises a one-piece flexible sheet 14 lined with three rigid sheet elements 15. Thus, abreast of the fold projections 7, the flexible sheet 14 acts as a hinge, and straddles or overlaps and perfectly matches the outline of the projection 7. Notches such as those illustrated in FIG. 1 may be omitted in this case.

In the two embodiments illustrated in FIGS. 1 and 2, the single or lined sheet 8 is rigid and enables a perfectly rigid box to be obtained after assembling said box into its shape. This stiffness enables the same to withstand stacking and the various handling operations occurring for example upon filling, carrying and storing the same.

Figure 3A:
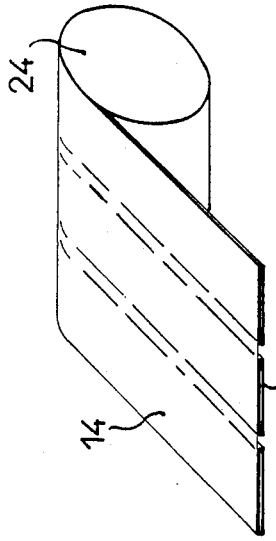
FIG. 3*a* is a pictorial view of the reel 24 of FIG. 3.
Figure 3:
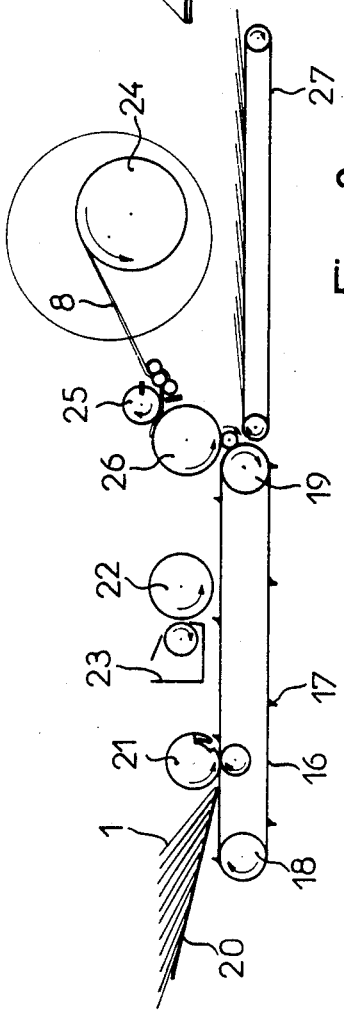
FIG. 3 is a diagrammatical side view in elevation of apparatus for carrying out a first embodiment of the method in accordance with the invention.

Apparatus for manufacturing the box is illustrated in FIGS. 3 and 3*a*. This apparatus comprises an endless chain 16 provided with catches 17 and driven by two rollers 18 and 19. The cardboard panels 1 are laid on the top run of the chain 16 and come from a supply system 20 of any desired kind known in the art and therefore not illustrated in detail herein. The panels 1 are fed in by means of a roller 21, then coated at 22 with an adhesive of the hot-melt type coming from a trough 23. The transparent sheet 8 is unwound from a reel 24, cut at 25 and then laid on a suction cylinder 26 for conveying on to a panel 1 supplied by means of the chain 16. After pressing the sheet 8 on to the adhesive-coated panel 1, the box is withdrawn by means of a delivery chain 27.

The reel or roll 24 illustrated in perspective in FIG. 3*a* comprises a flexible sheet 14 of transparent plastics material and three rigid strips 15, and thus forms the complex illustrated in FIG. 2*a* for production of the box according to FIG. 2.

It is also possible for a box according to FIG. 1, that is to say comprising a single rigid transparent plastics material sheet 8 only, to be produced by means of the apparatus of FIG. 3. In this case, the axis of the roll or reel supplying this sheet should be arranged at right angles to the delivery chain 27. Furthermore, a device for forming the notches 13 by excision and the required weakening lines should be positioned before the point at which the sheet 8 is combined with the panel 1.

The apparatus of FIG. 3 operates in a wholly continuous manner.

Figure 4:
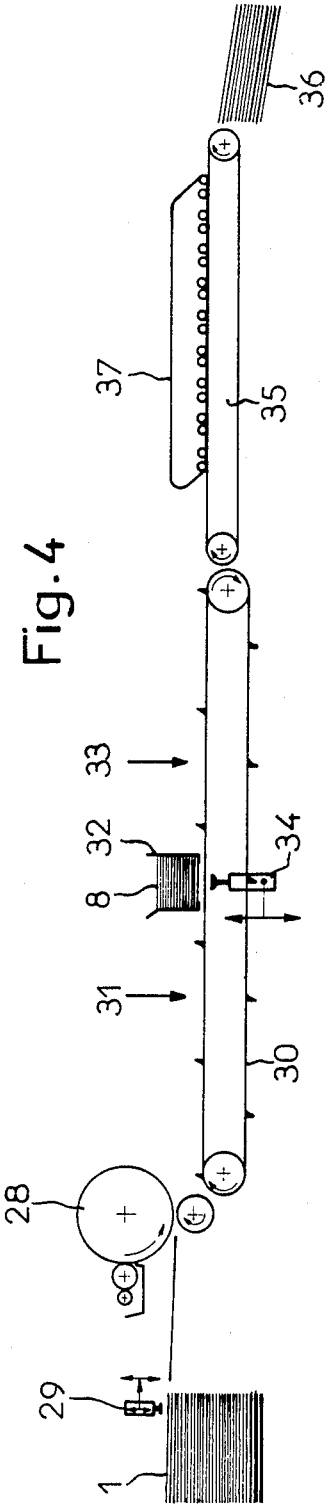
FIG. 4 is a diagrammatical elevational side view of a modified form of the apparatus illustrated in FIG. 3, FIGS. 5 to 11 show the successive stages of a second method for the manufacture of a box in accordance with the invention and, in these figures.

The apparatus of FIG. 4 operates in an intermittent manner, meaning that it is supplied with sheets 8 which are already cut out and ready to be placed on the panels 1. These panels 1 are fed to a coating station 28 by means of a suction-operated pick-up device 29. The panels 1 are then received on a chain 30 similar to chain 16 shown in FIG. 3 and travel successively to a known kind of hot-melt station 31 not illustrated in detail, below the magazine 32 distributing the sheets 8 and a pressing station 33 not illustrated therein. The withdrawal of the sheets 8 from the magazine 32 is performed by means of a suction device 34 situated below the chain 30 and fitted in such manner that it may be displaced in vertical direction, the sheets 8 being drawn by suction via the opening 3 of the panels 1. The panel 1—sheet 8 pair then leaves the chain 30 and is received on another delivery chain 35 which discharges the same to a reception station 36 after having exerted a pressure thereon by means of a mat 37 applied under thrust on the pair 1, 8.

The devices illustrated in FIGS. 3 and 4 render it possible to obtain very satisfactory results, but the positioning of the sheet 8 of transparent plastics material with respect to the cardboard panel 1, that is to say its precise alignment with respect to the opening 3, proves to be difficult and restricts production speeds in the case of both these devices. It is possible to make use of highly developed positioning or setting devices. In this case however, the production cost of the box rises to a high level and thereby becomes irreconcilable with particular practical applications.

To minimise or even eliminate this drawback, the invention also provides another method for the production of the box, which will be described in the following with reference to FIGS. 5 to 11.

Figure 5:
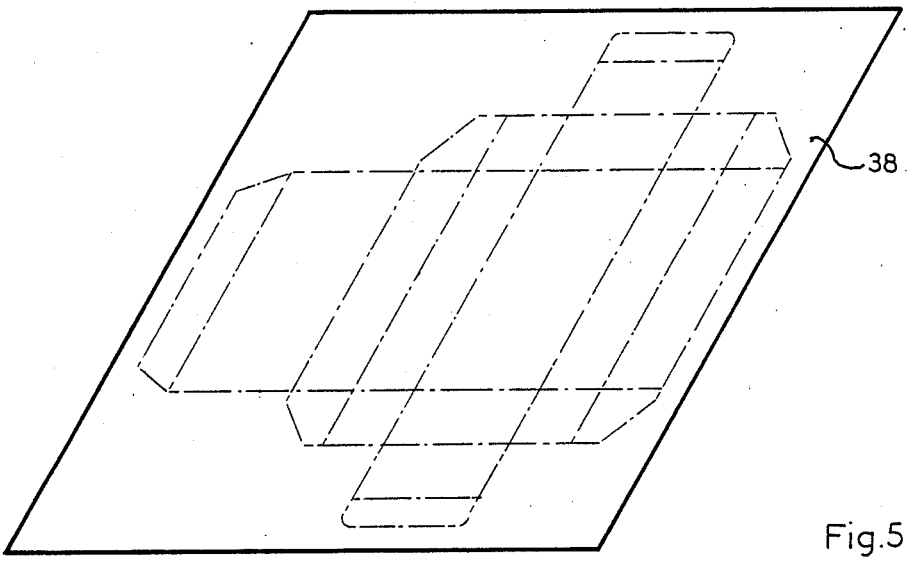
FIG. 5 shows a cardboard panel utilised for production of the box.
Figure 10:
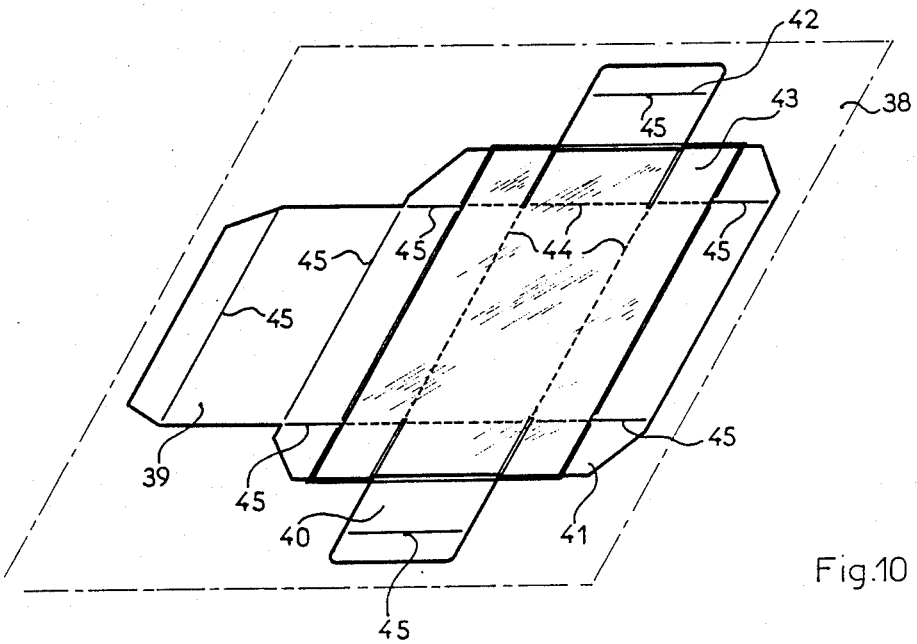

In FIG. 5 is shown a rectangular cardboard panel 38 from which one or more packaging or display boxes are produced. In accordance with the invention, the box again comprises an opening overlapping or straddling at least one of its edges and this opening is shut off by a sheet of rigid transparent plastics material. In FIG. 10, the cardboard sections of the box bear the references 39, 40, 41 and 42 whereas the reference 43 denotes the window intended to be covered by a rigid transparent plastics material sheet 48. Preparatory or incipient fold lines or scored lines of the plastics material sheet are illustrated by dotted lines at 44, and the scored lines of the cardboard sections 39 to 42 are shown at 45.

Figure 6:
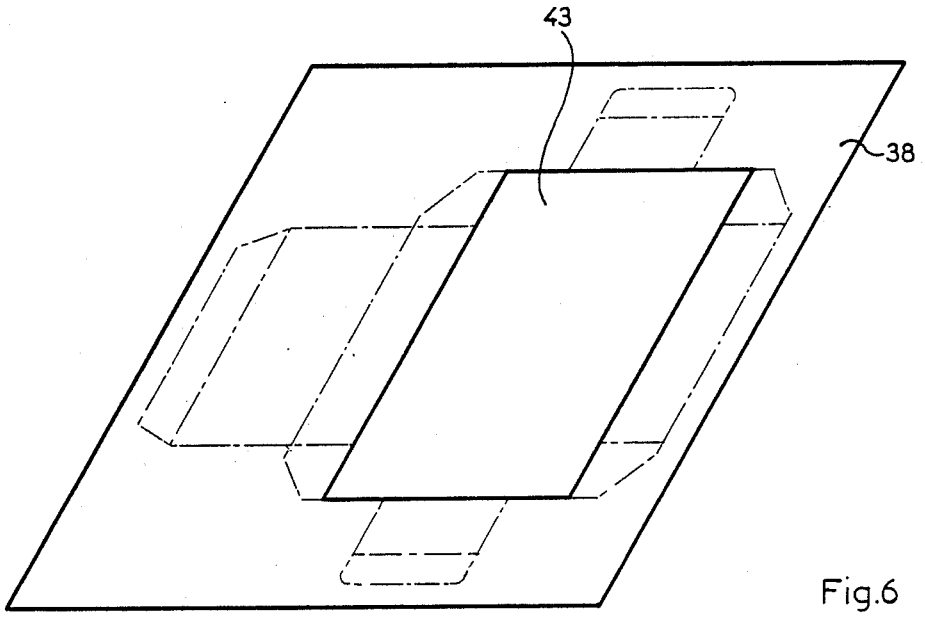
FIG. 6 shows the excision of a window in the cardboard panel.

In accordance with this particular embodiment of the method according to the invention, the cutting out of the window 43 in the cardboard panel 38 is undertaken initially as illustrated diagrammatically in FIG. 6. A tool (not illustrated) is utilised for this purpose, which comprises a framework arranged to be displaceable in vertical direction and which carries a series of cutting blades arranged to correspond to the outline of the window 43 which is to be cut out.

After excising the window 43, the same has laid on it a sheet 48 of a rigid transparent plastics material (FIG. 7) whose dimensions are a little larger than those of the window 43. The sheet 48 is cut out beforehand and simply positioned on the window in such manner as to cover the latter and overlap onto the cardboard sections. This operation requires moderate precision, since the sheet 48 is not as yet scored or grooved, which condition would have required an alignment to very great precision with respect to the future scored or grooved lines of the cardboard. This latter operation for positioning with very great position has proved to be difficult if it was intended to operate at high production speeds.

Figure 8:
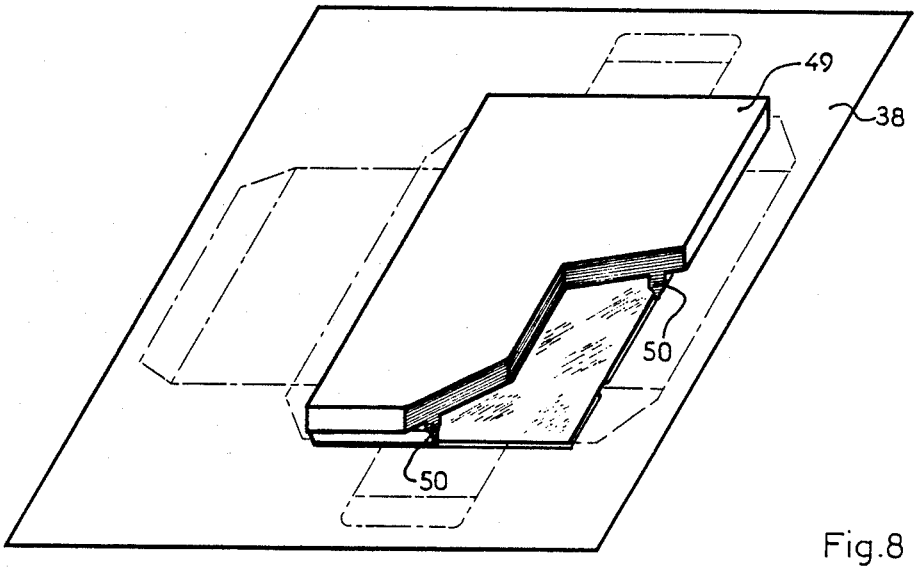
FIG. 8 shows the method of securing the plastics material sheet on the cardboard panel, FIG. 9 demonstrates the simultaneous scoring or grooving of the cardboard panel and of the plastics material sheet by mechanical means, FIG. 10 demonstrates the final cutting out of the cardboard panel.
Figure 9:
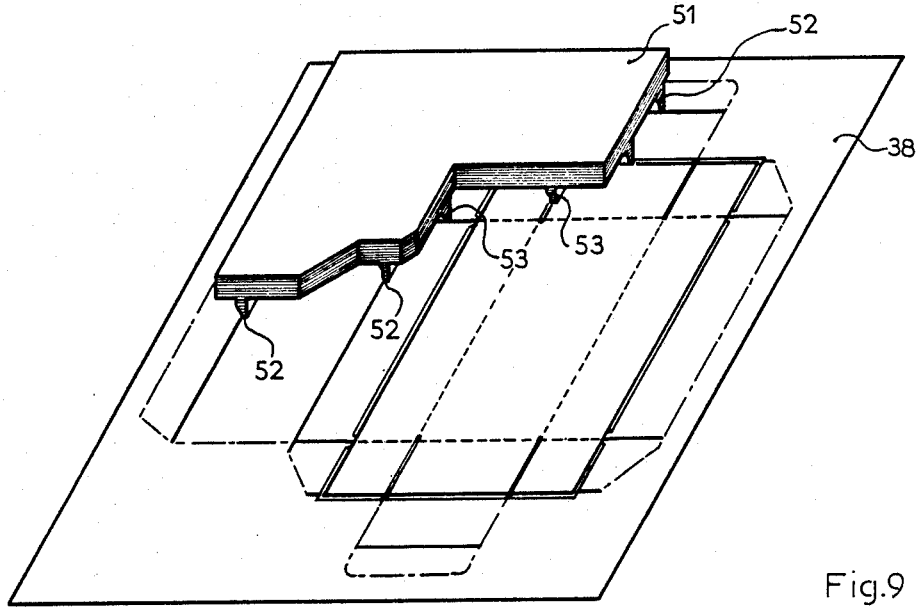

The plastics material sheet 48 correctly placed on the cardboard panel 38 is secured thereupon. This fastening action may be performed by gluing, but the sheet 48 and the cardboard panel 38 are preferably joined together by thermic welding and in particular by means of a high-frequency welding device as illustrated in FIG. 8. To this end, it is possible to utilise a tool comprising a framework 49 arranged to be displaceable in vertical direction and which bears welding electrodes 50 connected to a generator of high-frequency electric current not illustrated therein.

The simultaneous mechanical scoring or grooving of the cardboard panel 38 and of the plastics material sheet 48 are carried out during the next stage. Use is again made to this end of a tool comprising a framework 51 arranged to be displaceable in a vertical direction and which bears blades 52 for grooving or scoring the cardboard panel 38 and blades 53 having an appropriate structure for scoring or grooving the rigid plastics material sheet. The mutual alignment of the incipient folds thus formed on the cardboard panel 38 and the plastics material sheet 48 is assured by utilising a single tool without requiring positioning with high precision which would be impossible in a machine operating at high working speeds.

The cutting out of all of the cardboard sections 39 to 42 of the box is now shown by solid lines in FIG. 10. It will easily be appreciated that a box of this kind cannot be produced mechanically at high output rates except by applying this embodiment of the method of the invention, according to which the cutting out of the cardboard panel occurs only after the cutting out of the window 43 (FIG. 6) and after the placing in position (FIG. 7) and the fastening (FIG. 8) of the rigid plastics material sheet 48 on the cardboard panel. As a matter of fact, the cardboard sections 39 to 42 are interconnected only by the plastics material sheet 48. Their preliminary cutting out and subsequent individual fastening would represent a protracted and costly operation preventing any profitable mechanisation in practice.

In another modification of the method according to the invention, the grooving or scoring action on the plastics material sheet 48 may equally be performed by heat-welding.

In this case, the grooving action will be performed at the same time as the heat-welding (FIG. 8) of the sheet 48, and the framework 49 will carry appropriate grooving electrodes (not illustrated) apart from the electrodes 50.

Figure 7:
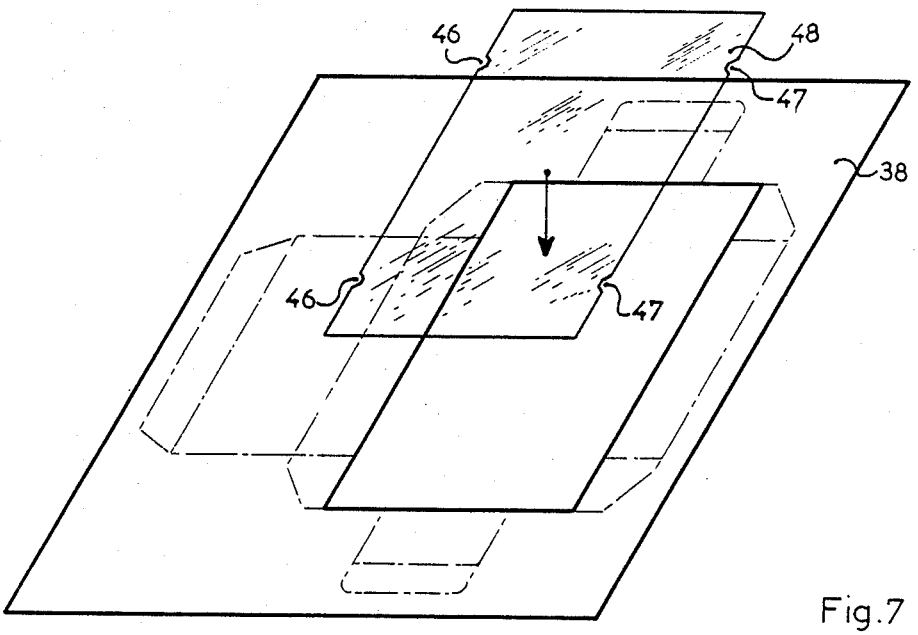
FIG. 7 shows the positioning in alignment with the window of a sheet of a rigid transparent plastics material.

Similarly, if there is a need to provide notches at the extremities of the grooves or scores of the plastics material sheet 48 as described in particular in the foregoing with reference to FIGS. 1 to 4 and as illustrated again in very sketchy manner at 46 and 47 in FIG. 7, these notches are produced by heat-weakening of the sheet 48 during the heat-welding stage (FIG. 8) and the framework 49 will carry the tools needed for this action. The notches 46 and 47 may however alternatively be produced beforehand by mechanical means before the plastics material sheet is placed in position (FIG. 7).

In accordance with a particularly economical embodiment, the grooving or scoring of the plastics material sheet 48 and the grooving and cutting out of the cardboard sections 39 to 42 of the box are performed during one and the same stage and with a single tool. This operation is performed after the plastics material sheet 48 has been placed in position and affixed in alignment with the opening 43.

Figure 11:
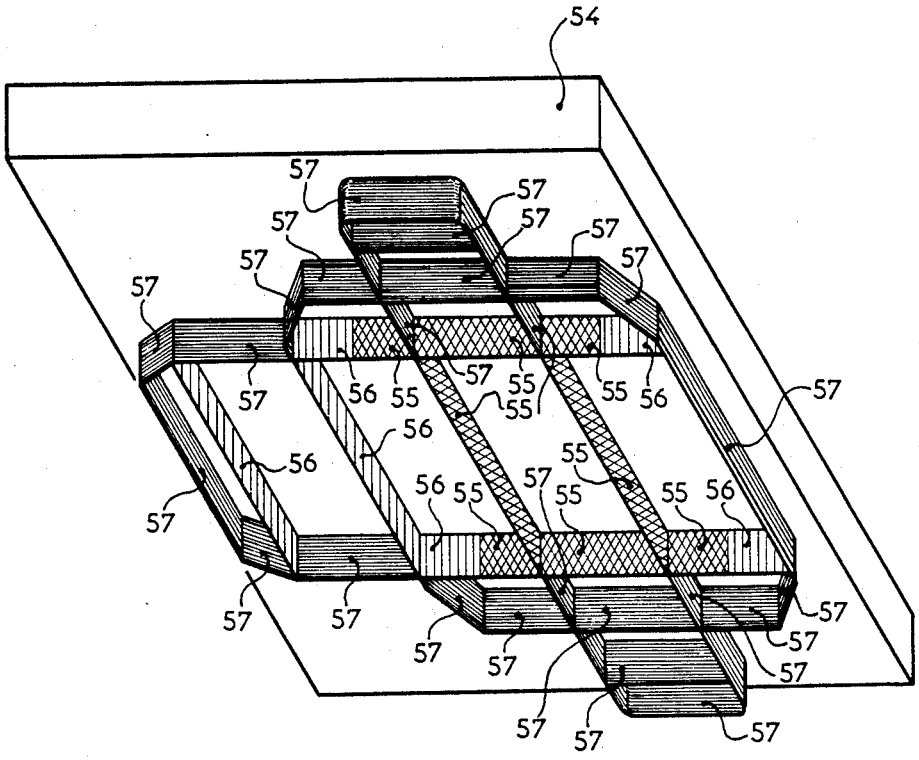
FIG. 11 is a view from below of a tool which renders it possible to perform simultaneous scoring or grooving and cutting out of the cardboard sections and the scoring or grooving of the plastics material sheet of the box in accordance with the invention.

FIG. 11 diagrammatically shows a tool which renders it possible to perform these three operations at the same time. This tool comprises a bearer 54 arranged to be displaceable in a vertical direction above a work table. The bearer 54 is provided with a series of rules 55 for grooving the plastics material sheet 48, a series of rules 56 for grooving the cardboard sections 39 to 42 and a series of cutting rules 57 for cutting out the cardboard panel. The marking and satisfactory alignment or registration of the scored or grooved lines with respect to each other are thus assured by the positioning of the rules 55, 56 and 57 on the bearer 54.

According to yet another version, the cutting out of the said opening 43, and the grooving and cutting out of the cardboard sections 39 to 42 may be performed at the same time before the plastics material sheet 48 is placed in position, and this with one tool only. In this case however, it is necessary to retain a series of narrow bridges between the sections 39 to 42 and the remainder of the panel: these bridges are broken at the end of production, after the placing in position, affixing and grooving of the plastics material sheet.

It will be apparent that the invention is not limited to the embodiments described and illustrated herein, and numerous changes may be made thereto without departing from the scope of the invention as defined by the appended claims.

I claim:

1. An erectable display box comprising a foldable blank including a first sheet of opaque material and a second sheet of rigid plastic material, said rigid plastic sheet being mounted to said opaque sheet so that said rigid plastic sheet overlaps an edge of said opaque sheet and said opaque sheet overlaps an edge of said rigid plastic sheet, said opaque sheet having at least one fold line formed therein and extending toward said edge of said rigid plastic sheet, said rigid plastic sheet having at least one fold line formed therein and extending toward said edge of said opaque sheet, said fold line in said rigid plastic sheet being in alignment with said fold line in said opaque sheet, and a notch in one of said first and second sheets at the end of its said fold line extending at least to said edge of the other of said sheet and said notch being of a size and shape such that it will accommodate the folded portion of the other one of said first and second sheets upon bending at said aligned fold lines.

2. An erectable display box according to claim 1 wherein said notch is in said rigid plastic sheet.

3. An erectable display box comprising a foldable blank including a first sheet of opaque material and a second sheet of rigid plastic material, a notch formed at the edge of one of said first and second sheets, said notch having an inner end, said one of said first and second sheets positioned with its edge overlapping an edge of the other of said first and second sheets and with the inner end of the notch extending at least to said edge of said other of said sheets; said second sheet being adhered to said first sheet over the full extent of said overlapped edges, a first fold line in said one of said first and second sheets aligned with said notch, a second fold line in the other of said first and second sheets aligned with said first fold line but being axially spaced therefrom for insuring independent folding of respective sheets about axially spaced aligned first and second fold lines while preventing unwanted deformation of the sheets upon bending about said aligned fold lines and said notch being of a size and shape such that it will accommodate the folded portion of the other one of said first and second sheets upon bending at said aligned fold lines.

4. The erectable display box of claim 3, wherein said notch is formed in said second sheet.

* * * * *